US006321672B1

(12) United States Patent
Dudek, II

(10) Patent No.: US 6,321,672 B1
(45) Date of Patent: Nov. 27, 2001

(54) SUBLIMATION EMBROIDERY

(76) Inventor: James Edward Dudek, II, 3756 Larchwood Pl., Riverside, CA (US) 92506

( * ) Notice: Subject to any disclaimer, the term of this patent is extended or adjusted under 35 U.S.C. 154(b) by 0 days.

(21) Appl. No.: 09/776,449

(22) Filed: Feb. 1, 2001

(51) Int. Cl.[7] ..... D05C 17/00
(52) U.S. Cl. ..... 112/475.22; 112/439
(58) Field of Search ..... 112/475.18, 475.22, 112/475.23, 439; 156/230; 428/914, 29, 202

(56) References Cited

U.S. PATENT DOCUMENTS 4,103,634 * 8/1978 Schachter ..... 112/475.18
5,005,219 * 4/1991 Diaz ..... 112/475.18
5,241,919 * 9/1993 Lagreca ..... 112/439
5,794,555 * 8/1998 Kwang ..... 112/475.22
5,878,681 * 3/1999 Asami ..... 112/475.18

* cited by examiner

*Primary Examiner*—Ismael Izaguirre
(74) *Attorney, Agent, or Firm*—Michael G. Petit

(57) ABSTRACT

A three dimensional embroidered pattern is sewn into a fabric using polyester monochromatic thread that is selected to take up a dye applied thereto. After the pattern is sewn into the fabric, a pattern comprised of sublimatable dyes is applied to a sheet substrate. The sheet substrate bearing the dye pattern is registered to contact the embroidered pattern and heated under pressure. The dyes comprising the pattern on the sheet substrate sublime and condense in the thread comprising the embroidered pattern adjacent thereto. When the sheet substrate is separated from the embroidery, a three dimensional colored pattern remains on the embroidery thread comprising the pattern. The visual appearance of the polychromatic pattern obtained when the dyes on the sheet substrate sublime and condense on the embroidered fabric is different than the pattern achieved when using variously colored threads to embroider the pattern on the fabric.

2 Claims, 1 Drawing Sheet

SUBLIMATION EMBROIDERY

BACKGROUND OF THE INVENTION

1. Field of the Invention

The present invention relates to embroidered art works and, more particularly, to a method for affixing a three dimensional polychromatic graphic to a fabric.

2. Prior Art

Embroidery is the art of decorating material, usually a textile fabric, by means of a needle and thread. The basic embroidery technique includes running stitches, satin stitches and fill stitches sewn on a substrate. An embroidering apparatus is operated to move an embroidery frame, which has a work or cloth held thereon to be embroidered, in the X-and Y-directions relative to the vertically reciprocating needle, thereby to form the embroidery stitches on the work. The embroidering apparatus generally includes two essential elements for moving the embroidery frame in the X-direction and in the Y-direction respectively.

Embroidery machines embroider an embroidery fabric in accordance with a computer-specified program. Since embroidery patterns are usually multi-colored, different-colored threads must be stitched in the embroidery pattern. This means that for one embroidery pattern, the embroidery thread must be changed multiple times. Currently, embroidery machines have automatic thread changers for up to twelve threads. If the design has more thread colors than the machine has needles, thread change must take place for sewing the correct sequence of colors required to construct the desired pattern. Such an additional colored thread must be manually pulled through a needle in preparation for sewing.

Embroidery sewing machines for producing an embroidery pattern in an embroidery area on a work sheet are well known in the art. Such machines produce a pattern by filling the embroidery area with stitches by means of a stitch-forming device having one or more sewing needles, each of which carries a colored thread. The needles reciprocate in an axial direction and a needle-thread catcher cooperates with the sewing needle to form the stitches into the work sheet. Such embroidery machines further may include a displacing device which displaces the stitch-forming device and the work sheet relative to each other; and a control device which controls the stitch-forming device and the displacing device so that a predetermined portion of the embroidery area is filled with mixed stitches formed of a plurality of color. Each color in the embroidered pattern corresponds to different needle threads. Due to the complexity of such multi-needle embroidery machines and the time required to embroider a polychromatic pattern on a fabric, it is an advance in the art to provide a method for producing polychromatic embroidery that requires the use of only a single colored (or white) thread for embroidering the pattern on the fabric. By using a four-color process for sublimation printing, subtle color blends and photorealism can be realized that cannot otherwise be achieved employing prior art embroidery methods that use spot color technology to construct a polychromatic embroidered pattern.

SUMMARY

It is a primary object of the present invention to provide a method for embroidering a polychromatic pattern on a fabric.

It is another object of the invention to provide a method for making a polychromatic embroidered pattern on a fabric wherein a monochromatic thread is used to embroider a monochromatic pattern the fabric and then colored dye is applied to the monochromatic pattern to provide a polychromatic pattern.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

BRIEF DESCRIPTION OF THE DRAWINGS

In FIG. 1(*a*), a pattern of sublimable dyes is printed on a sheet substrate.

FIG. 1(*b*) shown an embroidery machine used for sewing a monochromatic pattern on a sheet of fabric, FIG. 1(*c*) illustrates the dye transfer process employed for transferring color to the embroidered pattern.

DESCRIPTION OF THE PREFERRED EMBODIMENTS

Figure 1:
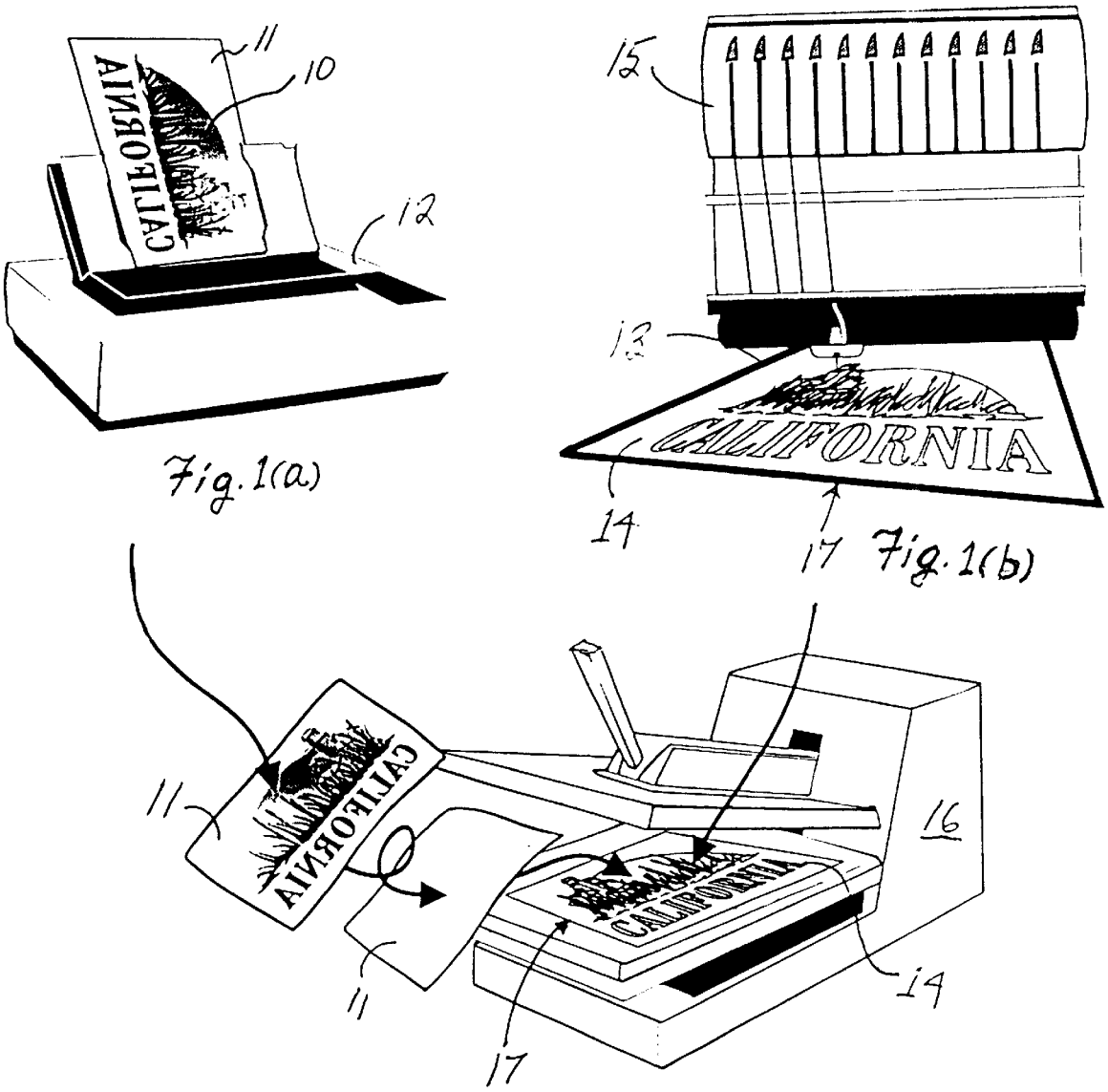
FIG. 1 is a flow digram illustrating the method for making color embroidery in accordance with the present invention.

Sublimation, or heat transfer printing is well known in the art. Such printing processes involve, as a first step, full color lithographic printing on paper using "dispersal" dyes having the property of subliming or vaporizing to a gas when heated. A second step involves transferring the printed image under heat and pressure, in a transfer press to a substrate formed of material which is receptive to the sublimable ink. The inks are capable of being printed onto the paper by screenprinting, lithographic printing, rotogravure and digital computer controlled printers, so that one can obtain the high quality and full color reproduction achievable by these techniques. Sublimation transfer processes have been found to be particularly useful in printing full color reproductions onto polyester fabric. Excellent color quality and efficient transfer is possible with such fabrics.

Turning now to FIG. 1, a flow diagram illustrating the steps required for making a polychromatic embroidered pattern on a fabric is shown. In FIG. 1*a*, a polychromatic image 10 comprising sublimable dyes, most preferably four sublimable dyes such as cyan, magenta, yellow and black and others that are commonly used in digital color printers, is transferred to a sheet of paper 11 via digital printer 12. With reference now to FIG. 1*b*, a raised (i.e., three dimensional) monochromatic pattern 13, such as a design, corresponding to image 10 is embroidered on a fabric 14 with white polyester thread using an embroidery machine 15. Turning now to FIG. 1*c*, the paper 11 is placed face down on the embroidered fabric 17 on the hot platen of a heat transfer printing device 16 and heated to 380–390 degrees F. under 70–80 pounds of pressure for 45 seconds. Under these conditions the dye on the paper 11 sublimes and is deposited on and within the adjacent underlying polyester threads comprising the pattern. The sheet of paper 11 is then separated from the fabric 14 leaving a polychromatic embroidered image on the fabric. The polychromatic embroidered pattern on the fabric has a different appearance than that attainable using conventional colored embroidery methods.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A method for forming a polychromatic embroidered pattern on textile fabric comprising the steps of:

(a) printing a polychromatic image of the pattern on a sheet of paper using sublimable dyes;

(b) embroidering a monochromatic image of the pattern on a fabric using a embroidery thread that binds to the sublimable dyes;

(c) placing the polychromatic image of the pattern on the paper in registerable contact with the monochromatic embroidered image on the fabric and applying pressure;

(d) heating the dye to a temperature sufficient to sublimate the dye; then (e) separating the paper and fabric, the polychromatic embroidered pattern remaining on the fabric.

2. A fabric bearing a polychromatic embroidered pattern made by a process comprising the steps of:

(a) printing a polychromatic image of the pattern on a sheet of paper using sublimable dyes;

(b) embroidering a monochromatic image of the pattern on a fabric using a embroidery thread that binds to the sublimable dyes;

(c) placing the polychromatic image of the pattern on the paper in registerable contact with the monochromatic embroidered image on the fabric and applying pressure;

(d) heating the dye to a temperature sufficient to sublimate the dye; then (e) separating the paper and fabric, the polychromatic embroidered pattern remaining on the fabric.

* * * * *